US006824451B2

(12) United States Patent
Hollatz et al.

(10) Patent No.: US 6,824,451 B2
(45) Date of Patent: Nov. 30, 2004

(54) PROCESS FOR THE ABRASIVE MACHINING OF SURFACES, IN PARTICULAR OF SEMICONDUCTOR WAFERS

(75) Inventors: Mark Hollatz, Neustadt (DE); Andreas Römer, Dresden (DE)

(73) Assignee: Infineon Technologies AG, Munich (DE)

( * ) Notice: Subject to any disclaimer, the term of this patent is extended or adjusted under 35 U.S.C. 154(b) by 100 days.

(21) Appl. No.: 10/186,971

(22) Filed: Jul. 1, 2002

(65) Prior Publication Data

US 2003/0013389 A1 Jan. 16, 2003

(30) Foreign Application Priority Data

Jun. 29, 2001 (DE) ..... 101 31 668

(51) Int. Cl.[7] ..... B24B 1/00

(52) U.S. Cl. ..... 451/56; 451/51; 451/155; 451/312; 408/158; 409/143

(58) Field of Search ..... 451/56, 51, 61, 451/27, 23, 155, 124, 157, 213, 444, 41, 28, 63, 268–270, 285–290, 443, 526, 539; 408/158; 409/143, 200; 74/57

(56) References Cited

U.S. PATENT DOCUMENTS

| | | | | |
|---|---|---|---|---|
| 5,725,417 A | | 3/1998 | Robinson | |
| 5,733,178 A | * | 3/1998 | Ohishi | 451/41 |
| 5,779,521 A | * | 7/1998 | Muroyama et al. | 451/56 |
| 5,890,951 A | * | 4/1999 | Vu | 451/56 |
| 5,958,794 A | * | 9/1999 | Bruxvoort et al. | 438/692 |
| 6,224,465 B1 | * | 5/2001 | Meyer | 451/41 |
| 6,267,644 B1 | * | 7/2001 | Molnar | 451/41 |
| 6,302,770 B1 | * | 10/2001 | Aiyer | 451/56 |
| 6,322,427 B1 | | 11/2001 | Li et al. | |

FOREIGN PATENT DOCUMENTS

| | | |
|---|---|---|
| DE | 199 38 781 A1 | 3/2001 |
| EP | 1 034 887 A2 | 9/2000 |
| EP | 1 050 369 A2 | 11/2000 |
| EP | 1 052 062 A1 | 11/2000 |
| EP | 1 080 839 A2 | 3/2001 |
| EP | 1 155 778 A2 | 11/2001 |
| JP | 2000 349 056 A | 12/2000 |

* cited by examiner

*Primary Examiner*—Lee D. Wilson
*Assistant Examiner*—Anthony Ojini
(74) *Attorney, Agent, or Firm*—Laurence A. Greenberg; Werner H. Stemer; Ralph E. Locher

(57) ABSTRACT

A process is described for the chemical mechanical machining of semiconductor wafers. A plurality of surfaces are successively subjected to a polishing step, in which they are brought into contact with a polishing device. The polishing device contains a polishing-grain carrier with polishing grains, and the surfaces are moved relative to the polishing device. Material is removed from the surface by the polishing grains, which are fixed in the polishing-grain carrier and may become partially detached from the carrier material during the polishing operation. In each case one or more polishing steps is preceded by a conditioning step for regeneration of the polishing device. The polishing device and a conditioning surface of strong structure are brought into contact with one another and moved relative to one another, with the result that starting states of the polishing-device surface at a beginning of the individual polishing steps are comparable with one another.

12 Claims, 1 Drawing Sheet

PROCESS FOR THE ABRASIVE MACHINING OF SURFACES, IN PARTICULAR OF SEMICONDUCTOR WAFERS

BACKGROUND OF THE INVENTION

Field of the Invention

The invention relates to a process for the abrasive machining of surfaces of semiconductors.

Chemical mechanical polishing (CMP) is frequently used in the production of large scale integrated circuits for the purpose of planarizing dielectrics or indirect structuring of wiring planes, i.e. for removing elevated areas from a structured surface. A liquid that has been mixed with polishing grains, preferably of a high hardness, and in some cases contains basic chemicals, known as a slurry, is often introduced between the surface of a semiconductor wafer that is to be machined and a polishing pad. The pad and the surface that is to be machined are in surface-to-surface contact with one another and are moved relative to one another, so that the polishing grains which move between the two surfaces abrade the surface which is to be machined.

High topography selectivity is desirable for efficient planarization of evenly structured surfaces. Therefore, elevated areas should be abraded to a greater extent than areas that lie at a lower level. This cannot be ensured under all circumstances by the slurry method, particularly when both large and very small structures occur together. The polishing grains that are entrained with the slurry are able to exert an abrading action even in the lower-lying regions, so that overall a greater amount of material than just the layer thickness of the elevated structures has to be removed for complete planarization.

Better results have recently been achieved by what is known as fixed abrasive CMP. In this process, the polishing pad is covered with a polishing device, e.g. a polishing cloth, in which the polishing grains are fixed in a polishing-grain carrier and only project above the surface of the latter in certain regions. In fixed abrasive CMP, the polishing device and the surface that is to be machined are brought into contact with one another and set in motion relative to one another. Depending on the specific device, this can be achieved by moving only one surface or by moving both surfaces. In addition, depending on the particular requirements it is possible to add suitable liquid chemicals, in order to produce chemical abrasion at the same time as the mechanical abrasion. Since the polishing grains only interact with the surface that is to be machined at the actual points of contact between the polishing devices and the surface which is to be machined, fixed abrasive CMP is able to achieve a particularly high topography selectivity.

In the strictest mechanical sense, fixed abrasive CMP is a grinding process rather than a polishing process, since the grinding or polishing grains cannot move freely, but rather are fixed randomly in a carrier, in particular at the surface of the latter. Nevertheless, in the present context the term "polishing" has become the accepted word, and consequently it will also be used in the present description.

It is inevitable that an in some cases considerable number of polishing grains will become detached from the carrier during the machining operation, depending on the type of wafer and/or polishing device, so that, first, a "true" polishing process also always takes place and, second, over the course of time the polishing device becomes blunt or aggressive, i.e. the amount of material removed per unit time drops or increases.

The latter phenomenon is extremely undesirable in series production, in which a large number of wafers are successively subjected to the same CMP working step, since the same, presettable parameters for a working step, such as for example machining time, chemicals selected, etc. would lead to different results depending on the degree of wear to the polishing device. Particularly as structures become ever smaller, fluctuations of this nature cannot be tolerated.

A phenomenon that has a similar result also occurs with the slurry method explained above. However, the processes that lead to the abrasive becoming blunt are different. Specifically, in the slurry method the surface of the pad, which is actually elastic, "vitrifies", i.e. its pores become blocked with the relatively small polishing grains and in particular with material that has been abraded from the surface that is to be machined. This leads to a hard and flat pad surface, leading to a considerable change in abrasion rates. This is generally counteracted by a cleaning roughening of the pad surface with the aid of a diamond needle. However, this method is too coarse for the fixed abrasive method, since it would lead to the substantially pore-free polishing-grain carrier being destroyed, and therefore it cannot be used for this method.

Therefore, the problem is currently combated by replacing the polishing device in steps in each case before machining of a new wafer. For example, certain CMP devices offer an automatic feed of polishing devices (roll to roll polisher). However, such a configuration is expensive in two respects. First, a device of this type requires considerable mechanical outlay. Second, the consumption of the polishing device is excessive. This is a significant cost factor. On account of the extremely small size of the structures that are to be machined, polishing cloth that is customarily used has to satisfy extremely high demands on accuracy both with regard to its mechanical properties and with regard to the number, size and uniformity of the polishing grains. This makes production complex and correspondingly expensive.

SUMMARY OF THE INVENTION

It is accordingly an object of the invention to provide a process for the abrasive machining of surfaces, in particular of semiconductor wafers that overcomes the above-mentioned disadvantages of the prior art methods of this general type, in which fluctuations in abrasion caused by the polishing device becoming blunt or aggressive are avoided as far as possible while the cost of replacing the polishing device is considerably reduced.

With the foregoing and other objects in view there is provided, in accordance with the invention, a process for abrasive machining. The process includes subjecting successively a plurality of wafers having surfaces of a first type to a polishing step. During the polishing step the surfaces of the first type are in each case brought into contact with a sheet-like polishing device. The polishing device has a polishing-grain carrier with polishing grains fixed therein. The surfaces of the first type are moved relative to the polishing device, so that, as a result of an interaction between the polishing grains fixed in the polishing-grain carrier and a surface being machined, material is removed from the surface, and during the polishing step the polishing grains can become at least partially detached from the polishing-grain carrier. A conditioning step is performed for regenerating the polishing device before performing the polishing step on at least one of the wafers having the surfaces of the first type. The conditioning step includes bringing the polishing device and a conditioning surface having a strong structure into contact with one another and moved relative to one another, with a result that a regenerated state of a polishing device surface is achieved. The regenerated state is a starting state of the polishing device surface before the polishing step is performed and starting states of different polishing steps are comparable with each other at a beginning of each of a series of the polishing steps. Wafers having a surface of a second type are used to provide the conditioning surface.

Specifically, these features have the following significance. Before each individual polishing step, i.e. in each case between the machining operations carried out on the surfaces which are to be machined in succession or in each case before a sequence of individual polishing steps, an intermediate step is carried out, in which the polishing device is brought into contact with and moved relative to a special conditioning surface having a strong topography, referred to below as the "dummy wafer". The result is that the polishing device is regenerated, so that before the beginning of a new polishing step on a new wafer, the polishing device is in approximately the same starting state as at a beginning of a preceding polishing step carried out on the wafer that has just been machined. This ensures that identical machining times lead to identical abrasion results, so that fluctuations in series production are avoided. Therefore, the polishing device only has to be replaced after a relatively large number of individual polishing steps. Therefore, incremental values for the individual polishing steps are reduced with regard to the polishing device. However, this number can easily be determined empirically for a given type of polishing device and a given topography which is to be machined and accordingly can easily be matched to the overall series production process.

The additional costs that are generated by the additional working step can easily be more than compensated for by the savings achieved by the reduced consumption of the polishing device. In addition, a greater process stability results in that less rework is required and a higher product quality can be achieved, with less variation between the products. Particularly for the remachining of wafers that have already been substantially planarized, conditioning of the polishing device as described by the present invention is advantageous or necessary.

The invention makes use of the discovery that current fixed abrasive polishing device, for example polishing cloths, have a body in which the polishing grains are in a three-dimensional, uniform distribution. However, in each case only the polishing grains that project above the surface of the carrier material interact with the surface that is to be machined. If the polishing grains become detached from the carrier surface during the polishing operation, the surface is depleted. However, the overall three-dimensional density of the polishing grains in the carrier scarcely changes. Individual grains become detached from the carrier surface primarily at an advanced stage of the planarizing operation. At an earlier stage, i.e. while the surface that is to be machined still has a strong topography, although individual grains are torn out of the surface, this action is associated with and compensated for by abrasion of the carrier material, which leads to further grains in lower layers of the polishing device being exposed. As a result, therefore, the blunting effect described above only occurs once the structures have been substantially leveled.

If a fixed abrasive polishing device that has become blunt is, in surface-to-surface contact with a strongly structured surface, moved relative to the surface, the abrasion of the carrier material predominates at the surface on account of the lack of polishing grains that can become detached. This exposes new polishing grains, until abrasion and detachment are in equilibrium. The polishing device is then fully regenerated. The corresponding surface properties can be reliably restored by repeating the process each time the polishing device has become blunt (i.e. degraded) and polishing a new wafer with the same starting parameters as the wafer which has previously been machined.

In accordance with an added mode of the invention, the conditioning step differs from the polishing step only with regard to a choice of surface that is brought into contact with the polishing device.

In accordance with another mode of the invention, there is the step of forming the conditioning surface from a hard ceramic. The conditioning surface has a microscopic topography, a roughened surface, and surface dimensions of the microscopic topography approximately correspond to a topography of the wafers which are to be machined during the polishing step. The conditioning surface may have a topography that has a microscopic distribution.

In accordance with a further mode of the invention, during the polishing step of polishing the surfaces of the first type, the wafers having the surfaces of the second type are used as the conditioning surface.

The wafers having the surfaces of the first type are used in the production of electronic components, in particular for producing memory elements.

In accordance with a concomitant feature of the invention, during a first processing phase for polishing the surfaces of the first type, wafers having the surfaces of the second type to be polished in a second processing phase are used as the wafers having the conditioning surface.

Other features which are considered as characteristic for the invention are set forth in the appended claims.

Although the invention is illustrated and described herein as embodied in a process for the abrasive machining of surfaces, in particular of semiconductor wafers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
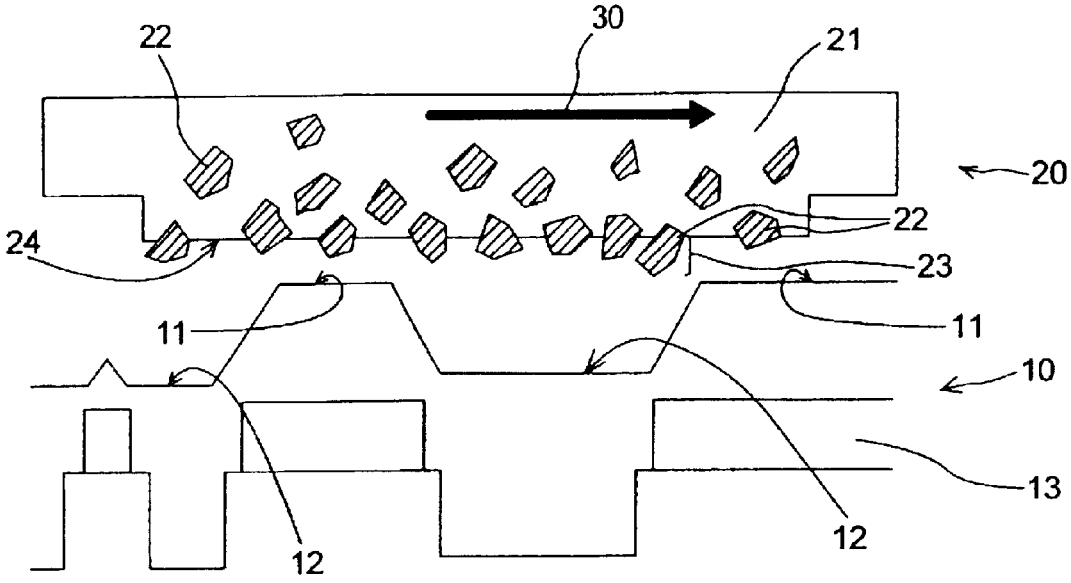
FIG. 1 is a diagrammatic sectional view of a part of a wafer and of a polishing device.

Referring now to the figures of the drawing in detail and first, particularly, to FIG. 1 thereof, there is shown diagrammatically part of a wafer 10 which is to be machined and of a fixed abrasive polishing device, e.g. a polishing cloth 20. The wafer 10 has an even more strongly structured surface with elevated regions 11 and valleys 12. The topography may, for example, be the result of the application of a dielectric layer to a lower, strongly structured wiring plane 13. The object of the chemical mechanical process (CMP) is to planarize the wafer surface, i.e. to abrade it at least down to the level of the valleys 12. The polishing cloth 20 that is used for this purpose and is pulled onto a polishing pad, e.g. a rotating or stationary plate, which is not shown in FIG. 1, contains a body 21, in which polishing grains 22 are distributed in three dimensions, irregularly but in a density that is substantially constant throughout the body 21. The polishing grains 22 that lie next to a polishing-cloth surface 24 penetrate through the surface 24 in certain regions, so that their projecting regions 23, during surface contact of the polishing device 20 and a relative movement with respect to the wafer surface that is indicated by a movement arrow 30, can interact abrasively with the surface. Particularly large amounts of material are abraded from the areas of the elevated surface regions 11. In the valleys 12, in contrast, there is initially no abrasion. This leads to the desired, high topographical selectivity of the fixed abrasive method. The process is generally assisted by an addition of liquid chemicals that may have an etching action and are to be selected appropriately according to the desired abrasion and the substrate that is to be abraded. A resultant, purely chemical abrasion, which may also take place in the valleys 12, can be largely ignored in the present considerations.

Figure 2:
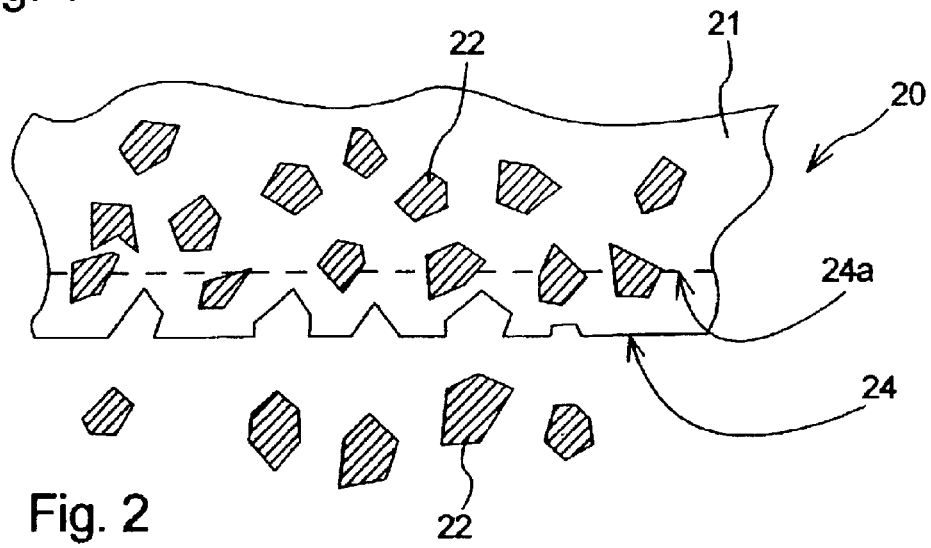
FIG. 2 is a diagrammatic sectional view of part of the polishing device with a view to clarifying a blunting and regeneration effect.

After the wafer surface has been planarized to the desired layer thickness, the polishing cloth is in a blunt or degraded state that is diagrammatically illustrated in FIG. 2. A multiplicity of the polishing grains 22 whose regions 23 penetrated through the polishing-cloth surface 24 in FIG. 1 have now been detached from the body 21. In this state, interaction with the wafer surface that is to be machined takes place substantially through the soft polishing-cloth surface itself or through the detached polishing grains, which can now move freely. However, the latter are rapidly washed away by the liquid chemicals, so that the abrasion rate drops rapidly. A new wafer 10, were it to be treated with the degraded polishing cloth 20 of this type, would have to be machined for a considerably longer time in order to achieve the desired layer thickness.

The inventive insertion of a conditioning step, on the other hand, allows the body material 21 to be abraded down to a new polishing-cloth surface 24*a*.

The new surface 24*a* has approximately the same number of polishing grains 22 projecting through it as the original surface 24 before it became degraded. The polishing cloth has been regenerated.

Figures 3A, 3B, 3C:
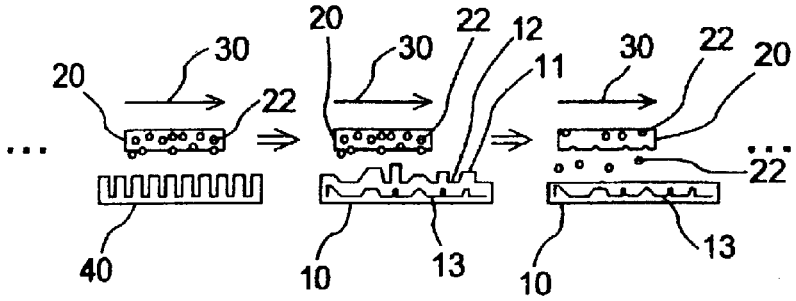
FIGS. 3A–3C are sectional views diagrammatically depicting a particular embodiment of a process sequence according to the invention.

FIGS. 3A–3C show diagrammatic illustrations of excerpts of the process according to the invention. First of all, in a machining step shown in FIG. 3A, the polishing cloth 20 is conditioned by machining a dummy wafer 40. There then follows, in a further step shown in FIG. 3B, the actual machining of a wafer 10 until state shown in FIG. 3C is reached, in which the wafer 10 has been planarized and the polishing cloth 20 has largely become blunt again. This is followed by a new cycle of the steps shown in FIGS. 3A, 3B and 3C. As a result, for each wafer 10 of a series using the same working parameters, such as machining time, chemicals used, etc., the same layer thicknesses are achieved and fluctuations in the series are minimized.

Even for a new polishing device 20 that has not yet been used, it is advantageous to carry out the conditioning step in FIG. 3A. This ensures that even the first machining step (FIG. 3B) takes place using the same starting parameters as the subsequent machining steps. However, if the conditioning operation (FIG. 3A) is optimized in such a way that precisely the conditions of a new, unused polishing device 20 is achieved, the first conditioning step can be dispensed with. The dummy wafer 40 advantageously has a strong topography that, for example, extends in a grid form over the entire dummy wafer 40. The structure ensures that all regions of the polishing device 20 are conditioned uniformly. This makes it possible to avoid subsequent fluctuations in layer thickness on the wafer 10. The strong topography has two advantages. First, good abrasion of the body material of the polishing device 20 is achieved. Second, the dummy wafer 40, even if it is subject to a certain abrasion itself, can be reused a large number of times before its structures have been planarized to such an extent that sufficient regeneration of the polishing device 20 is no longer ensured.

In a further advantageous embodiment, there is provision for the conditioning surface 40 to have a microscopic topography, in particular roughness, the surface dimensions of which approximately correspond to those of the wafer structures 11, 12 which are to be machined during the polishing steps B. Standard roughnesses or topographies, e.g. in diamond conditioning for slurry processes, are in the range from approximately 10 to 100 $\mu$m. The topographies that are desired according to the invention in this instance are smaller. Furthermore, the topography on the conditioning device may be distributed in macroscopic form, in order, during the conditioning process, to additionally clean the pad as a result of the polishing slurry being made turbulent between the conditioning surface and the pad surface.

The same objective can also be promoted by the choice of material for the dummy wafer 40. It is preferable to use a material that is harder than the wafer surface 11, 12 which is to be machined in the subsequent polishing step (FIG. 3B). In particular, a hard ceramic is recommended. This minimizes the abrasion to the dummy wafer 40. However, it is also possible to combine various production or recycling processes with one another. For example, it is possible for a first series of wafers 10 in a defined production or reprocessing phase to be used as the dummy wafers 40 for a second series of wafers 10 that are in a different phase. In this way, the two series are machined alternately.

Depending on the rate at which the blunting process takes place during the machining operation, it is, of course, also possible for each conditioning step (FIG. 3A) to follow a plurality of machining steps (FIG. 3B) rather than a single machining step, in which case the fluctuations in layer thickness caused by the polishing device 20 becoming blunt (degraded) remain within permissible tolerances during this plurality of machining steps.

For inexpensive series production, it may be particularly advantageous if the machining parameters, such as machining time, chemicals used, direction and speed of the relative movement between the polishing device and the wafer 10 or the dummy wafer 40, etc., are identical during the conditioning operation and the machining operation. In this case, it is possible for the sequence of process steps to be configured purely through the sorting of wafers 10 and dummy wafers 40. On the other hand, in certain cases it may also be advisable for the parameters of the conditioning step to be optimized separately from the machining steps. This is recommended in particular if the machining times are significantly longer than those required for the conditioning and/or if a dedicated device is used for the conditioning.

Of course, the embodiments of the process according to the invention that have been described are merely examples that are aimed at illustrating this process without having any restrictive nature.

We claim:

1. A process for abrasive polishing, which comprises the steps of:

subjecting successively a plurality of wafers having surfaces of a first type or in a first production phase to a polishing step, during the polishing step the surfaces of the wafers are in each case brought into contact with a sheet-like polishing device, the polishing device having a polishing-grain carrier with polishing grains fixed therein, and the surfaces of the wafers are moved relative to the polishing device, so that, as a result of an interaction between the polishing grains fixed in the polishing-grain carrier and a surface being polished, material is removed from the surface, and during the polishing step the polishing grains can become at least partially detached from the polishing-grain carrier;

performing a conditioning step for regenerating the polishing device before performing the polishing step on at least one of the wafers, the conditioning step includes:

bringing the polishing device and a conditioning surface having a structure into contact with one another and moved relative to one another, with a result that a regenerated state of a polishing device surface is achieved by exposing additional polishing grains, the regenerated state being a starting state of the polishing device surface before performing the polishing step and starting states of different polishing steps being comparable with each other at a beginning of each of a series of the polishing steps; and using further wafers having a surface of a second type or in a second production phase as the conditioning surface.

2. The process according to claim 1, which comprises performing the conditioning step to differ from the polishing step only with regard to a choice of surface which is brought into contact with the polishing device.

3. The process according to claim 1, wherein the conditioning surface is formed from a hard ceramic.

4. The process according to claim 1, wherein the conditioning surface is formed with a microscopic topography, and surface dimensions of the microscopic topography approximately correspond to a topography of the wafers which are to be machined during the polishing step.

5. The process according to claim 4, wherein the microscopic topography is a roughened surface.

6. The process according to claim 1, wherein the conditioning surface has a topography with a microscopic distribution.

7. The process according to claim 1, which comprises during the polishing step of polishing the surfaces of the wafers, using the further wafers as the conditioning surface.

8. The process according to claim 1, which comprises using the wafers for producing electronic components.

9. The process according to claim 1, which comprises using the wafers for producing memory elements.

10. The process according to claim 1, wherein the structure of the conditioning surface is harder than the surfaces of the first type.

11. A process for abrasive polishing, which comprises the steps of:

subjecting successively a plurality of wafers having surfaces to a polishing step, during the polishing step the surfaces are in each case brought into contact with a sheet-like polishing device, the polishing device having a polishing-grain carrier with polishing grains fixed therein, and the surfaces of the wafers are moved relative to the polishing device, so that, as a result of an interaction between the polishing grains fixed in the polishing-grain carrier and a surface being polished, material is removed from the surface, and during the polishing step the polishing grains can become at least partially detached from the polishing-grain carrier;

performing a conditioning step for regenerating the polishing device before performing the polishing step on at least one of the wafers, the conditioning step includes:

bringing the polishing device and a conditioning surface having a structure into contact with one another and moved relative to one another, with a result that a regenerated state of a polishing device surface is achieved by exposing additional polishing grains, the regenerated state being a starting state of the polishing device surface before performing the polishing step and starting states of different polishing steps being comparable with each other at a beginning of each of a series of the polishing steps; and using further wafers having a surface being different from the surfaces of the wafers to be polished as the conditioning surface.

12. A process for abrasive polishing, which comprises the steps of:

subjecting successively a plurality of wafers having surfaces in a first production state to a polishing step, during the polishing step the surfaces are in each case brought into contact with a sheet-like polishing device, the polishing device having a polishing-grain carrier with polishing grains fixed therein, and the surfaces are moved relative to the polishing device, so that, as a result of an interaction between the polishing grains fixed in the polishing-grain carrier and a surface being polished, material is removed from the surface, and during the polishing step the polishing grains can become at least partially detached from the polishing-grain carrier;

performing a conditioning step for regenerating the polishing device before performing the polishing step on at least one of the wafers, the conditioning step includes:

bringing the polishing device and a conditioning surface having a structure into contact with one another and moved relative to one another, with a result that a regenerated state of a polishing device surface is achieved by exposing additional polishing grains, the regenerated state being a starting state of the polishing device surface before performing the polishing step and starting states of different polishing steps being comparable with each other at a beginning of each of a series of the polishing steps; and using further wafers having surfaces of a second production state as the conditioning surface.

* * * * *